US007029359B1

(12) United States Patent
Garcia

(10) Patent No.: US 7,029,359 B1
(45) Date of Patent: Apr. 18, 2006

(54) THROWING DISC TOY

(76) Inventor: Modesto Garcia, 3269 Clairmont Rd. NE, Atlanta, GA (US) 30329-1017

( * ) Notice: Subject to any disclaimer, the term of this patent is extended or adjusted under 35 U.S.C. 154(b) by 113 days.

(21) Appl. No.: 10/828,388

(22) Filed: Apr. 20, 2004

(51) Int. Cl.
*A63H 27/00* (2006.01)

(52) U.S. Cl. ..... 446/46; 446/48; 273/147

(58) Field of Classification Search ..... 446/46–48; 40/324; 473/588; 273/147
See application file for complete search history.

(56) References Cited

U.S. PATENT DOCUMENTS 4,031,655 A * 6/1977 Ponciano et al. ..... 446/47
4,320,593 A * 3/1982 Sarkis ..... 446/47
4,370,824 A * 2/1983 Resnicow ..... 446/48
4,503,635 A * 3/1985 Harrington ..... 446/46
6,468,123 B1 * 10/2002 Valencia ..... 446/48
6,764,371 B1 * 7/2004 Hartman et al. ..... 446/46
2003/0022587 A1 * 1/2003 Calco ..... 446/48
2003/0092351 A1 * 5/2003 Collier ..... 446/48

* cited by examiner

*Primary Examiner*—Kien Nguyen
(74) *Attorney, Agent, or Firm*—Stephen J. Stark; Miller & Martin PLLC

(57) ABSTRACT

A throwing disc is provided having a plurality of equally spaced scoops about an intermediate circumference of a disc. The scoops communicate air from a top surface of a disc through a mouth of a scoop to a bottom surface of the disc wherein the transfer of the air from the top towards the bottom is believed to provide additional lift. The additional lift can be utilized for additional distance especially when combined with removable circumferential weighting.

18 Claims, 8 Drawing Sheets

Fig,12
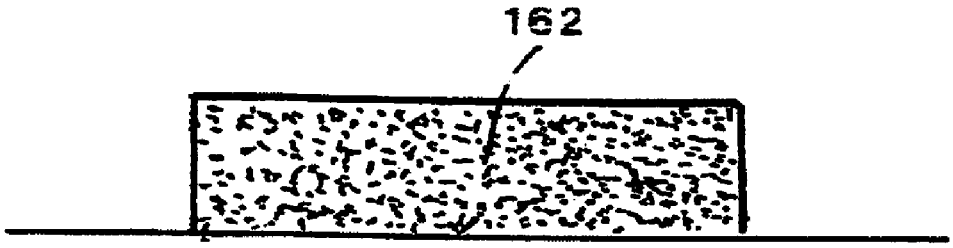
Fig.13
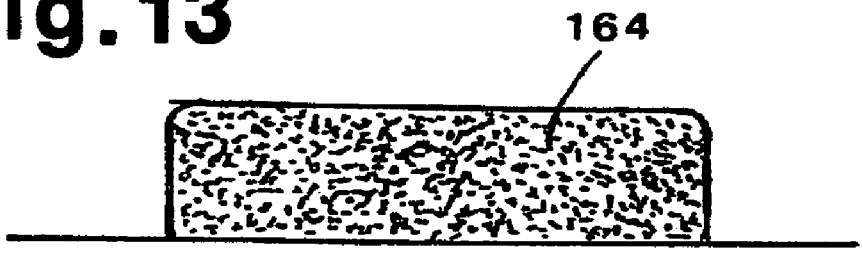

THROWING DISC TOY

FIELD OF THE INVENTION

This invention relates to a throwing disc and more particularly to an improvement to a design to increase at least one of lift and distance for a thrown disc.

DETAILED DESCRIPTION OF RELATED ART

The Whamo(™) Corporation has marketed and sold a product known as the Frisbee(™) for many years. This device is a circular throwing disc with a curved lip. The device is believed to rely on its aerodynamic shape to provide a hovering capability as it is thrown and spins. U.S. Pat. No. 4,176,843 is one that shows an improvement to this basic design.

While throwing discs are certainly a popular toy, the applicant believes that if it were made to be more aerodynamic then even greater enjoyment could be had. Accordingly, it is believed to be a need to provide a more aerodynamic toy.

SUMMARY OF THE INVENTION

Accordingly, it is an object of the present invention to provide a throwing disc with improved aerodynamic capability.

It is another object of the present invention to provide a throwing disc having a plurality of evenly spaced scoops which are believed to impart an additional element of lift to the disc when thrown in a particular direction.

Another need exists to provide a circumferentially weighted throwing disc.

Accordingly, a throwing disc of the preferred embodiment provides a plurality of evenly spaced scoops about a top surface, said scoops receiving an inflow of air therein from the top surface and directing the air through each of the scoops to below a bottom surface of the disc thereby assisting in generating lift upon rotation of the disc. Scoops could include two, three, four or more evenly spaced scoops. Additionally, the disc may be weighted around a periphery such as with a removable metal wire. The additional weight has been found helpful to assist in the distance that the disc may be propelled. When combining the added weight with additional lift, longer distances are believed to be possible than with the unimproved prior art designs.

BRIEF DESCRIPTION OF THE DRAWINGS

The particular features and advantages of the invention as well as other objects will become apparent from the following description taken in connection with the accompanying drawings in which:

FIG. 12 is a first embodiment of a mouth for use with the embodiment of FIG. 11; and FIG. 13 is a second embodiment of a mouth for use with the embodiment shown in FIG. 11.

DETAILED DESCRIPTION OF THE PREFERRED EMBODIMENT

FIGS. 1–3 and 7–10 relate to a first preferred embodiment of the present invention. FIGS. 4–10 relate to an alternatively preferred embodiment. Additionally, in the presently preferred embodiment and the alternatively preferred embodiment is directed to a right handed throwing operation while the alternatively preferred embodiment is directed to a left handed throwing operation as will be understood in the explanation provided below.

Figure 1:
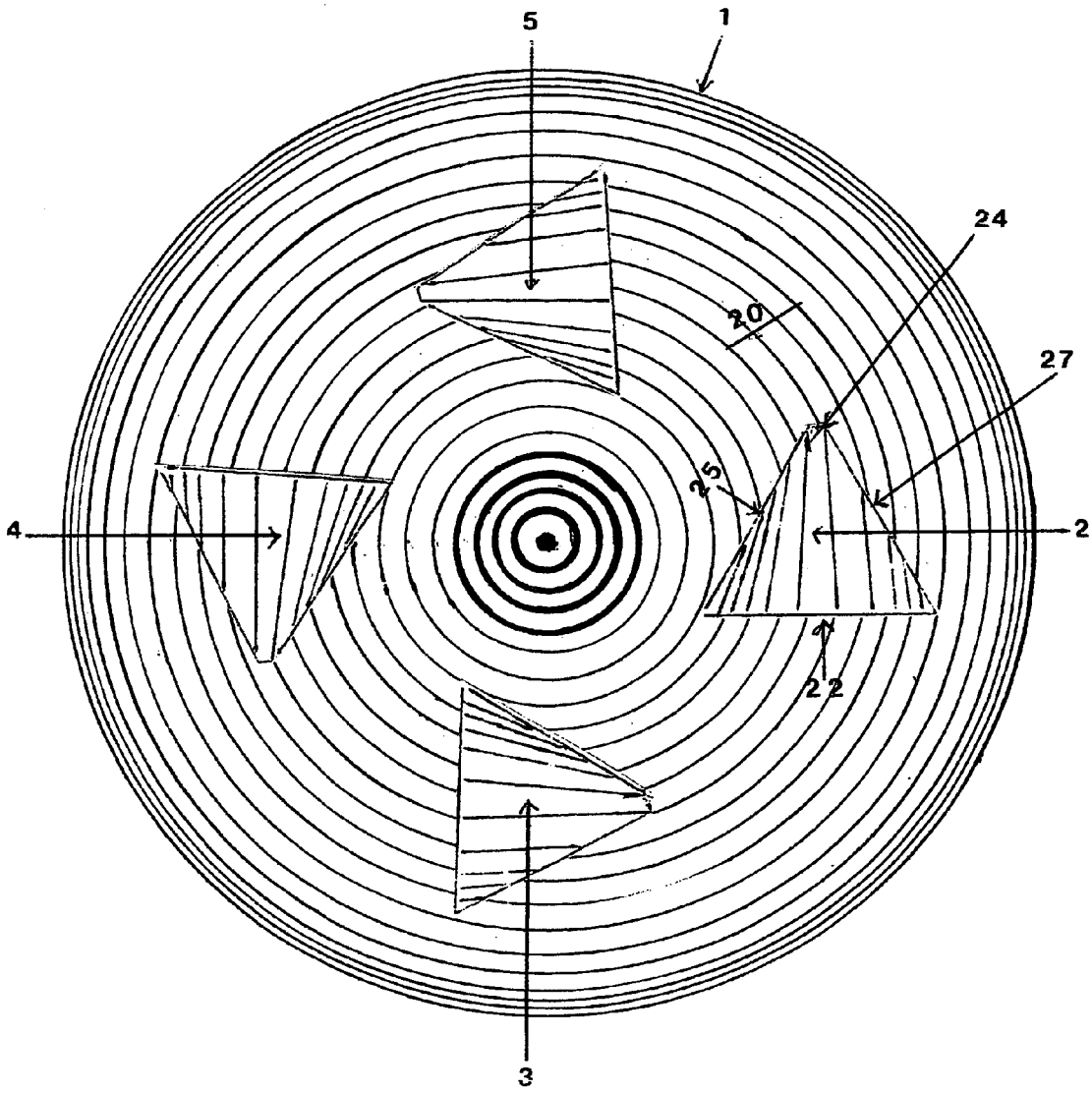
FIG. 1 is a top plan view of a throwing disc of the presently preferred embodiment of the present invention.

FIG. 1 is a top plan view of a disc 1. Disc 1 has a top surface 20 with a plurality of scoops 2,3,4,5 extending at least partially therefrom. The scoops 2,3,4,5 are characterized by a mouth 22 and a tail 24 spaced apart by sides 25,27.

The scoops 2,3,4,5 are equally spaced about an intermediate circumference of the disc 1. Although four scoops are illustrated, 2,3,4,5, more scoops 2,3,4,5 may be utilized in other embodiments. When utilizing an even number of scoops 2,3,4,5, it is anticipated that scoop pairs such as pair 2,4 and pair 3,5 will be arranged. The pairs 2,4 and 3,5 are each comprised of scoops 2,4 and 3,5 which are located along a diameter of the disc 1.

Figure 2:
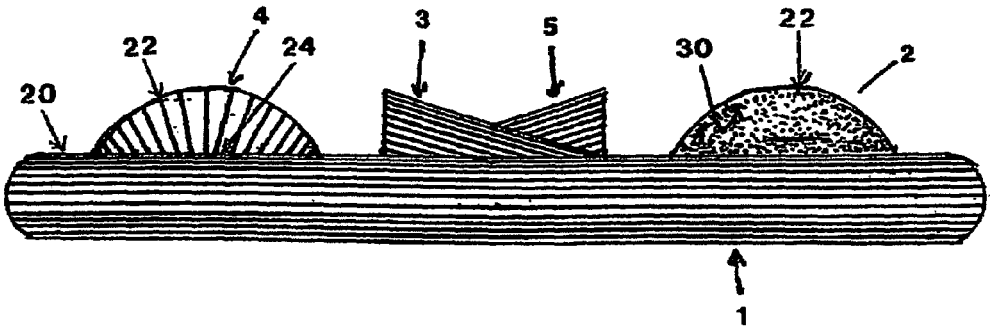
FIG. 2 is a side view of the disc of FIG. 1.

FIG. 2 shows a side plan perspective. Scoop 4 is shown extending from a tail 24 to a mouth 22. The mouth 22 extends a distance above the top surface 20 of the disc 1 as illustrated. The tail 24 in the preferred embodiment contacts the top surface 20 as shown. The mouth 22 is shown with respect to scoop 2 whereas the tail 24 is obscured from view in FIG. 2 since a passage 26 is created intermediate the mouth 22 and the top 20 of the disc. The passage 26 communicates fluid from above the top surface 20 to a bottom surface 28 as shown in FIG. 3.

Accordingly, when thrown by a right handed thrower, the disc is spun clockwise as it is thrown. The mouths 22 are directed into the air whereby air enters into the mouth 22, passes through the passage 26 and passes down below the bottom surface 28 of the disc. As the air passes into the passage 26, it encounters the angled and/or curved surface 30 of the underside of the scoop as shown in FIG. 2 and is directed downwardly down below the bottom surface 28 as the air proceeds from the mouth 22 towards the tail 24 of each of the scoops.

By pushing air from the top 20 of the disc 1 to a bottom 28 of the disc 1, increased lift is believed to occur over a traditional design.

Figure 3:
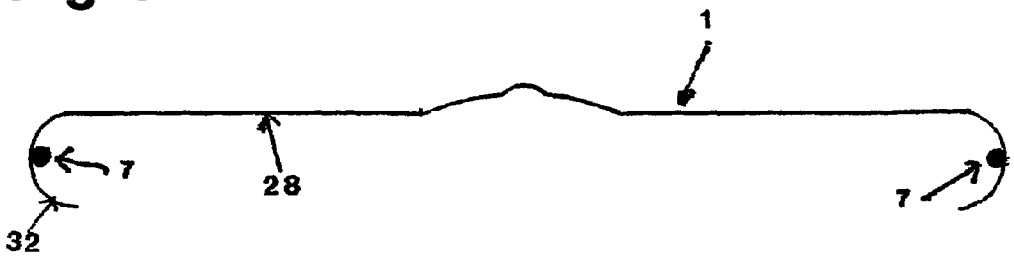
FIG. 3 is a cross-sectional view of the disc shown in FIG. 1 taken along the line A—A showing the wire.
Figure 7:
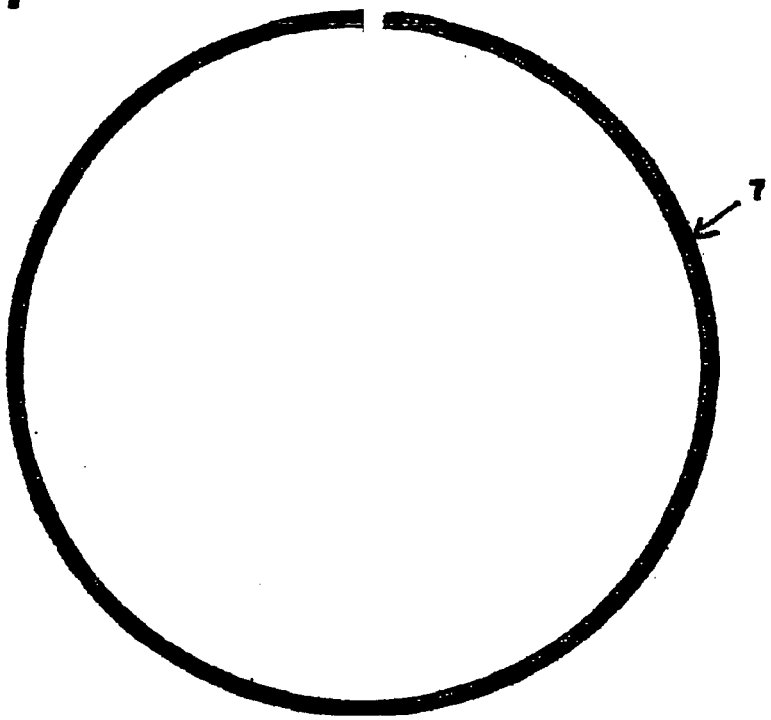
FIG. 7 is a top plan view of the wire when inserted in the disc as shown in FIGS. 3 and 6.
Figure 8:
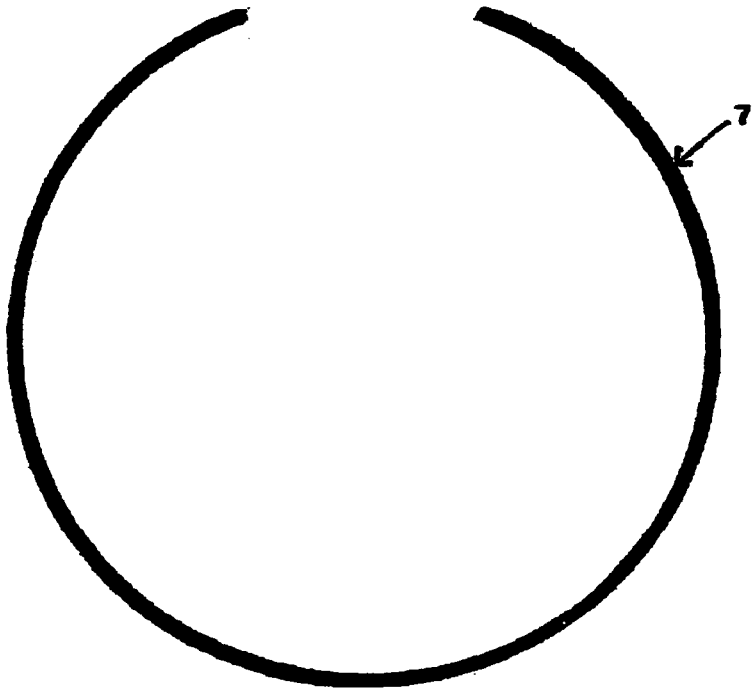
FIG. 8 is a top plan view of the wire prior to inserting into the disc of the present invention.

FIG. 3 is a cross sectional view of a disc 1. A weighted member 7 is shown in an installed position in FIG. 3 interior to an outer perimeter of a curved lip 32 which downwardly extends from the top 20 and passes the bottom surface 28 of the disc 1. The lip is preferably curved wherein it assists in retaining the weighted member 7 in position. FIGS. 7 and 8 show the weighted member 7. FIG. 8 shows the curved wire removed from the disc in a sprung configuration. FIG. 7 shows the weighted member 7 in tension so that it would remain connected to the lip 32 by spring action. Of course, other weighting and connection techniques could also be utilized.

By providing the scoops 2,3,4,5 increased lift is believed to be attained on the disc 1. In order to take advantage of the increased lift to provide for additional distance, the circumference of the lip 32 is weighted with the weighted member 7 so that the additional lift forces can be utilized in conjunction with the extra weight to provide what is believed to amount to extra distance. Of course, if extra distance is not desired, the weighted member 7 can be removed from the disk 1 such as when playing with small children.

In the preferred embodiment FIGS. 1 and 2, the scoops 2–4 preferably utilize a mouth 22 having a width at the top surface 20 greater than a width of the tail 24 as measured from the sides as can be seen at the top 28 as can be seen from the drawings. This feature is believed to further assist in pushing the air as it enters the passage 26 above the top 20 of the disc 1 to the bottom 28 of the disc 1.

Figure 4:
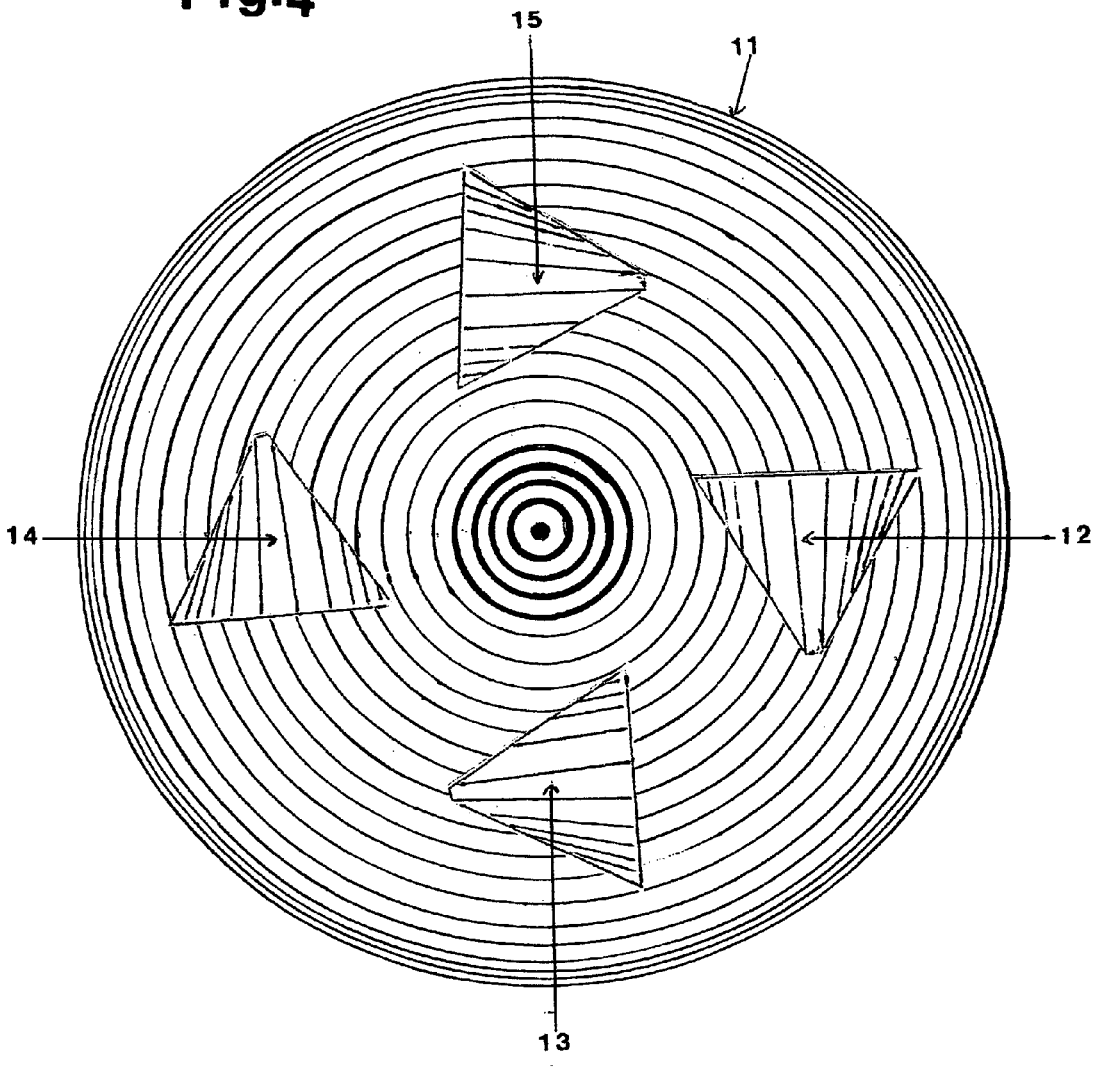
FIG. 4 is an alternatively preferred embodiment of the disc as shown in FIG. 1 designed for left handed use.
Figure 5:
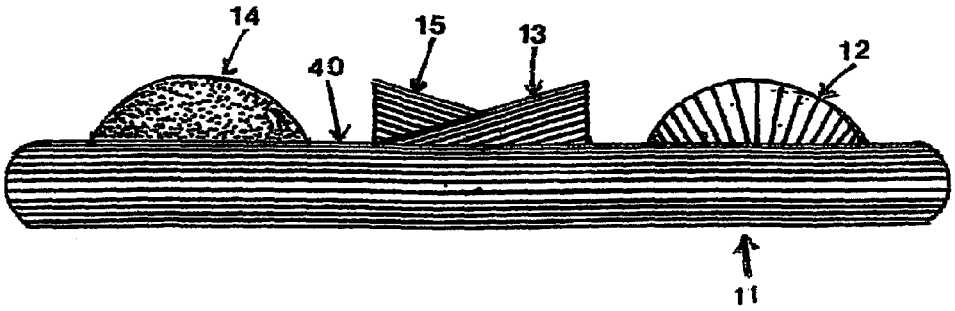
FIG. 5 is a side view of the alternative embodiment of FIG. 4.
Figure 6:
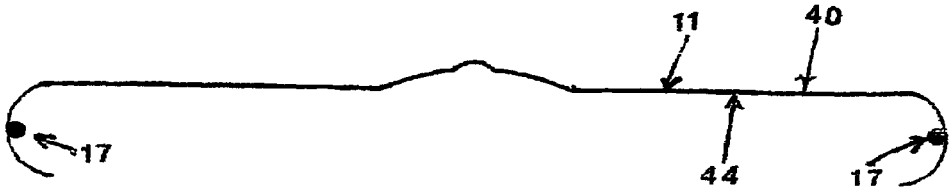
FIG. 6 is a cross-sectional view taken along the line B—B of FIG. 4.

FIGS. 4–6 show the left handed version, namely as a left hander would grab the disc it would twist counter-clockwise instead of clockwise like the embodiment of FIGS. 1–3. Accordingly, in this embodiment, a disc 11 is provided as the scoops 12,13,14 and 15. FIGS. 5 and 6 also show the scoops 12,13,14 and 15 above a top 40 of the disc 11. FIG. 6 shows the disc 11 having a bottom surface 44 and a top surface 40. It will be understood by the reference to the embodiment of FIGS. 1–3 that the similar operation is obtained for the embodiment of FIGS. 4–6 as it is obtained for the embodiment of FIGS. 1–3 except that this is designed for a left-handed operation or counter-clockwise spinning as opposed to clockwise spinning of a right handed operation of the presently preferred embodiment of FIGS. 1–3.

It is anticipated the disc will be injection molded, however, it may be formed in two other methods as well. Although no bottom view is provided with the figures, it will be understood for those skilled in the art that in the preferred embodiment the top 20 of the disk 1 terminates at each of the scoops 2,3,4,5 namely, that there is preferably no top surface 20 extending below the scoops 12,13,14,15. However, in other embodiments, it may be possible for the top surface 20 to stop intermediate mouth 22 and the tail 24. However, it is necessary for each of the passages 26 to communicate the fluid from the top surface 20 to the bottom surface 28 through the mouth 22 of the scoops 2,3,4,5.

Figure 9:
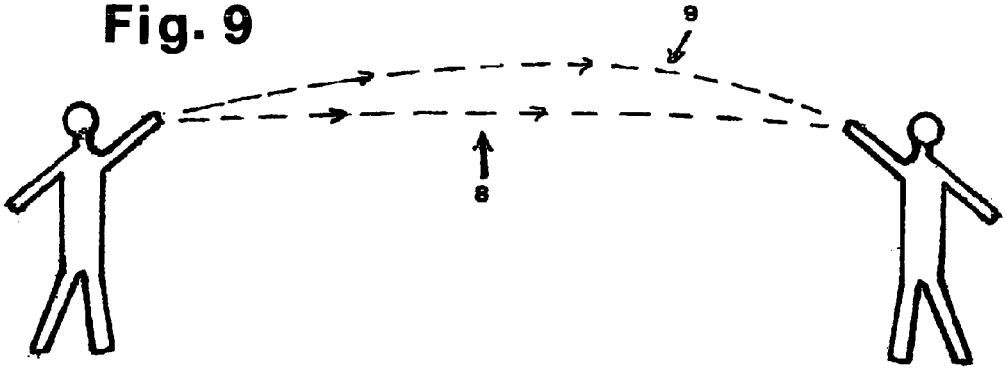
FIG. 9 shows two people enjoying the present invention.
Figure 10:
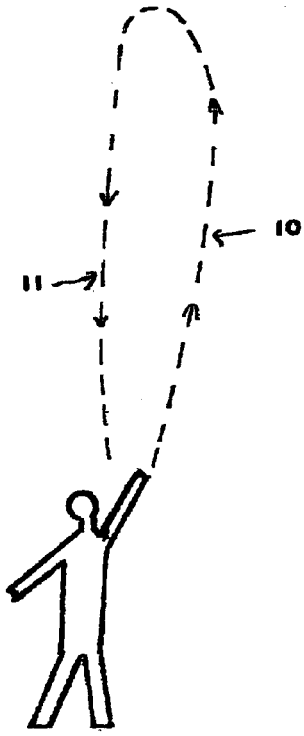
FIG. 10 shows a single person enjoying the present invention.

FIG. 9 shows the flight of discs 1,11 as path 9 as compared to prior art flight path 8 when played with by two people 100,102. FIG. 10 shows a single person 104 tossing one of discs 1,11 upwardly along path 110 and it returning along path 111.

Figure 11:
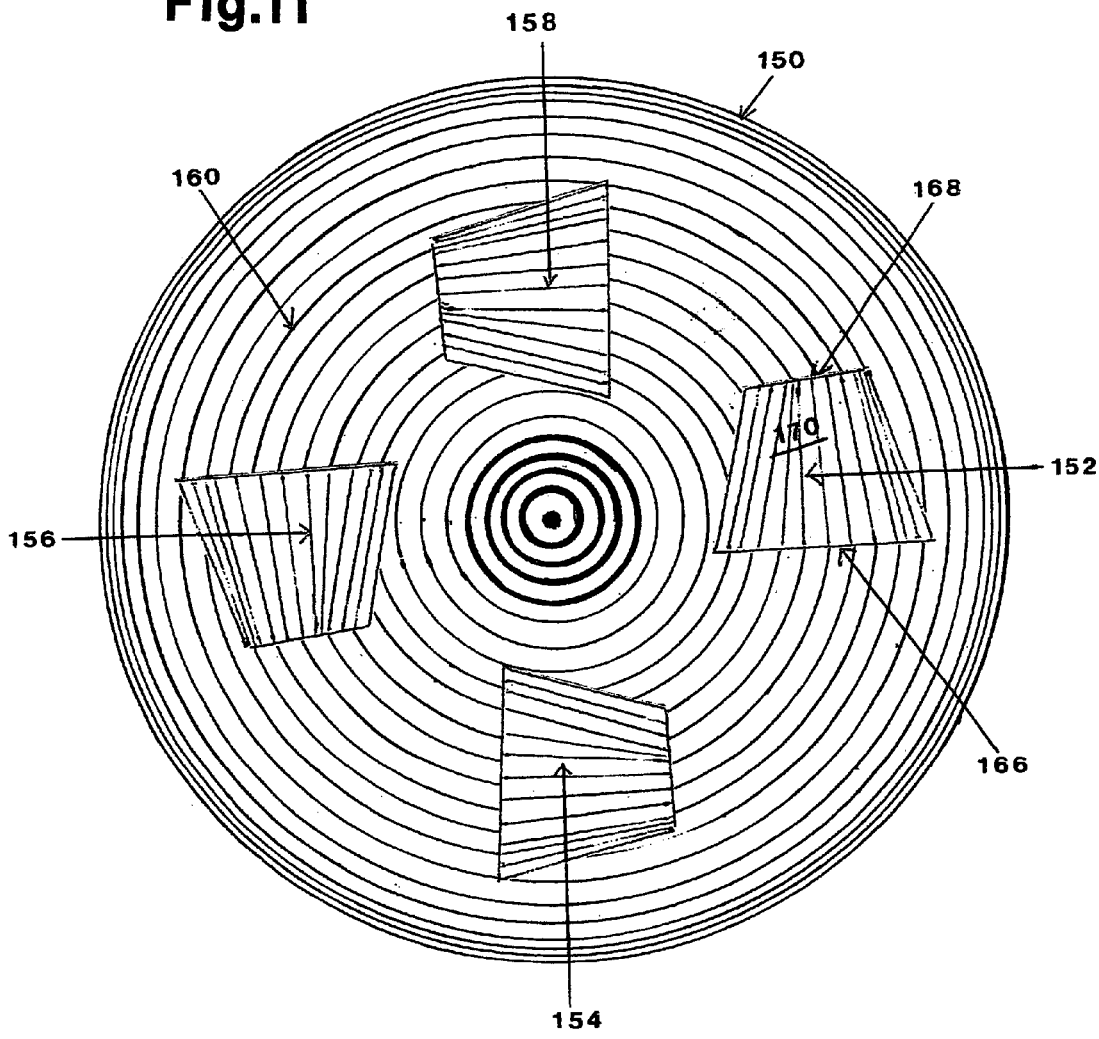
FIG. 11 shows a second alternatively preferred embodiment having a slightly different scoop configuration as soon from a top plan view.

FIG. 11 shows a second alternatively preferred embodiment 150 with scoops 152,154,156,158 on a top surface 160 of the disc 150. FIGS. 12 and 13 show possible scoop mouth 162,164 embodiments. As this second alternative embodiment shows, different scoop configurations could be utilized. In these configurations, a scoop mouth 166 as shown in FIG. 11 is wider than scoop tail 168. Furthermore, in the preferred embodiment, the scoop tail connects to the top surface 160 of the disc 150 while the mouths 166 (162 and 164) are open so that as the air enters the mouth, it will be directed by the underside of the top surface 170 of the scoop downwardly from above the top surface 160 to below the disc 150 thereby assisting in providing lift when thrown by a right hand thrower in a clockwise manner for this embodiment.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

The invention claimed is:

1. A throwing disc comprising:

a disc member having a top surface and a bottom surface, an intermediate and an outer circumference;

a curved lip extending from the disc member;

a plurality of spaced apart scoops extending from the top surface of the disc member, each of said scoops having a mouth extending a distance above the top surface, each of said scoops providing a passage intermediate the mouth and the top surface of the disc to the bottom of the disc respectively through the scoops; said scoops equally spaced about intermediate circumference of the disc member.

2. The throwing disc of claim 1 wherein each of the scoops have a tail spaced from the respective mouth, said tail having a width narrower than the mouth.

3. The throwing disc of claim 1 wherein the mouth is curved across a width of the mouth.

4. The throwing disc of claim 3 wherein the scoop is connected to the top of the disc member at sides.

5. The throwing disc of claim 4 wherein the sides are angled toward one another as the scoop proceeds from the mouth to a tail.

6. The throwing disc of claim 1 further comprising a weighted member along the curved lip.

7. The throwing disc of claim 6 wherein the weighted member is detachably connected to the lip.

8. The throwing disc of claim 7 wherein the weighted member is a weighted ring, said ring biased against a circumference of the curved lip when installed.

9. The throwing disc of claim 1 wherein the plurality of scoops comprises an even number of scoops.

10. The throwing disc of claim 9 wherein at least two scoops are located along a diameter of the disc member.

11. A throwing disc comprising:

a substantially round disc member having a top and a bottom;

a curved lip downwardly extending from the disc member;

at least two scoops connected to the top of the disc member and spaced from one another, said scoops each having a mouth extending a distance above the top of disc member and a passage defined intermediate the mouth and the top of the disc member; each of said passages communicating the top of the disc member with the bottom through the scoops respectively.

12. The throwing disc of claim 11 wherein the scoops are molded with the top of the disc member.

13. The throwing disc of claim 11 formed of a unitary construction.

14. The throwing disc of claim 11 wherein each of the scoops further comprises sides and a tail and wherein the scoop connects to the top of the disc member, the sides commencing at the mouth and terminating at the tail.

15. The throwing disc of claim 14 wherein the sides are closer together at the tail than at the mouth.

16. The throwing disc of claim 15 wherein the mouth is curved intermediate the sides.

17. The throwing disc of claim 16 in combination with a removable weighted member connected at the curved lip member when installed.

18. The throwing disc of claim 17 wherein the weighted member is a curved wire biased into position when installed.

* * * * *